United States Patent [19]

Mon

[11] Patent Number: 4,733,695

[45] Date of Patent: Mar. 29, 1988

[54] FLUIDIC SET-POINT PRESSURE SENSOR

[75] Inventor: George Mon, Potomac, Md.

[73] Assignee: The United States of America as represented by the Secretary of the Army, Washington, D.C.

[21] Appl. No.: 111,848

[22] Filed: Oct. 13, 1987

[51] Int. Cl.[4] ..... F15C 3/00

[52] U.S. Cl. ..... 137/829; 137/835; 137/840; 137/468

[58] Field of Search ..... 137/829, 835, 840, 833, 137/468

[56] References Cited

U.S. PATENT DOCUMENTS

| | | | |
|---|---|---|---|
| 3,578,010 | 5/1971 | Campagnuolo | 137/840 |
| 4,246,935 | 1/1981 | Mon | 137/840 |
| 4,369,811 | 1/1983 | Manion et al. | 137/819 |
| 4,523,611 | 6/1985 | Drzewieki | 137/804 |
| 4,534,383 | 8/1985 | Phillippi et al. | 137/840 |

OTHER PUBLICATIONS

Mon, "Temperature Compensation of Laminar Fluidic Components and Systems", Proceedings of the 20th Anniversary of Fluidic Symposium, ASME 1980 Nov. 16–21, pp. 95–102.

*Primary Examiner*—A. Michael Chambers

*Attorney, Agent, or Firm*—Saul Elbaum; Guy M. Miller; Thomas E. McDonald

[57] ABSTRACT

A modified laminar proportional amplifier with feedback for converting the absolute pressure of a pressurized fluid to a differential pressure indicating the pressure of the pressurized fluid relative to a predetermined set-point pressure. The device includes two outlets separated by a splitter, a supply nozzle for directing a jet of the pressurized fluid toward a first of the two outlets at a velocity determined by the absolute pressure and a feedback path for deflecting the jet toward the second outlet such that as the jet increases to a maximum value and then decreases until the differential pressure between the two outlets is equal to zero when the absolute pressure of the pressurized fluid is equal to the predetermined set-point pressure. The feedback path includes an adjustable fluidic resistor and a temperature compensated flow controller for making the device insensitive to temperature.

4 Claims, 6 Drawing Figures

FLUIDIC SET-POINT PRESSURE SENSOR

RIGHTS OF GOVERNMENT

The invention described herein may be manufactured, used and licensed by or for the United States Government for Governmental purposes without payment to me of any royalty thereon.

BACKGROUND OF THE INVENTION

1. Field of the Invention

The present invention relates generally to fluidic set-point pressure sensors and more particullarly to a fluidic set-point pressure sensor with feedback and temperature compensating characteriatics.

2. Description of the Prior Art

U.S. Pat. No. 4,523,611 filed May 1983 by Drzedwiecki describes a fluidic apparatus for converting the absolute pressure of a pressurized fluid to a differential pressure indicating the fluid pressure relative to a reference pressure. The pressurized fluid is directed asymmetrically into a laminar proportional amplifier (LPA) along a centerline towards a first of two outlets at a velocity determined by the fluid pressure. The LPA includes first and second control inlets disposed on opposite sides of the directed fluid jet and connected to a common source of control fluid. The first control inlet being disposed on the same side as the first outlet and the second control inlet being disposed on the same side as the second outlet. The first and second control inlets include respective first and second donwstream control edges which are asymmetrically disposed on opposite sides of the jet, with the second control edge being disposed closer than the first control edge to the center line. Consequently, the jet is deflected towards the second outlet in accordance with the jet velocities such that the differential pressure generated by the jet between the first and second outlets is zero when the fluid pressure is equal to the reference pressure. The first and second control inlets may include variable fluidic resistors which can be varied to adjust the reference pressure. This device however, is limited in reference pressures that may be obtained as well as being limited in gain.

An improved device is disclosed by Phillippi et al. in U.S. Pat. No. 4,534,383. The invention is similar to the set-point pressure sensor disclosed by Drzedwiecki, however, the device is dimensioned and disposed such that, as the pressure of the pressurized fluid supplied to the LPA is increased from zero, the differential pressure generated by the jet of pressurized fluid between the first and second outlets of the LPA is zero at two different supply pressures. Phillippi et al. utilizes the higher of these two pressures at which the differential pressure generated by the jet between the first and second outlets is zero resulting in a device which can obtain much higher reference pressures as well as much higher gains. Both of the devices described herein above rely on critical asymmetrical arrangements of the elements, such as control edge spacing, in the LPA as well as very high fluidic ground resistors tied to the control inlets. The set-point pressure set in these devices uses the restricted entrainment process through these resistors tied to the control inlet. Because these resistors have a very high value and very small flow passage in relation to the supply nozzle resistance, $R_g$ approximately equals $100R_s$, these devices are very sensitive to temperature changes.

SUMMARY OF THE INVENTION

It is therefore an object of the invention to provide a fluidic set-point sensor that is not sensitive to temperature changes.

It is a further object of the invention to provide a fluidic set-point sensor that does not rely on critical internal dimensions in an LPA for proper operation.

It is still a further object of the invention to provide a fluidic set-point sensor that uses feedback to control the set-point pressure.

The invention described hereinafter is similar in operation to the set-point sensor described in the above referenced U.S. Pat. Nos. 4,523,611 and 4,534,383. However, the internal dimensions of the sensor described herein are not critical to its operation, the sensor uses feedback to perform the control function and may use a temperature compensated fluid flow controller to make the device temperature insensitive. In the present invention the nozzle in the modified LPA receiving a pressurized fluid has a slight offset, causing the pressurized fluid to direct a jet of fluid along a centerline to a first outlet. An adjustable fluidic resistor is used in a feedback loop providing a path from the first outlet to a control inlet for deflecting the jet towards a second outlet. The feedback resistor is on the order of the same resistance as the resistance of the supply nozzle. The feedback loop may also contain a temperature compensated fluid flow controller to make the device insensitive to temperature changes. This feedback set-point sensor can be made independent of temperature or be made to schedule for temperature. As such, this device permits control of supply pressures in a manner which permits for example, fluidic oscillators to be operated at constant frequency over a broad range of temperature and pressure and may be used in control systems which depend on the gain of applifiers remaining constant.

The above and other objects, features and advantages of the present invention will be better understood from the following detailed description taken in conjunction with the accompanying drawings.

DESCRIPTION OF THE PREFERRED EMBODIMENTS

Figure 1:
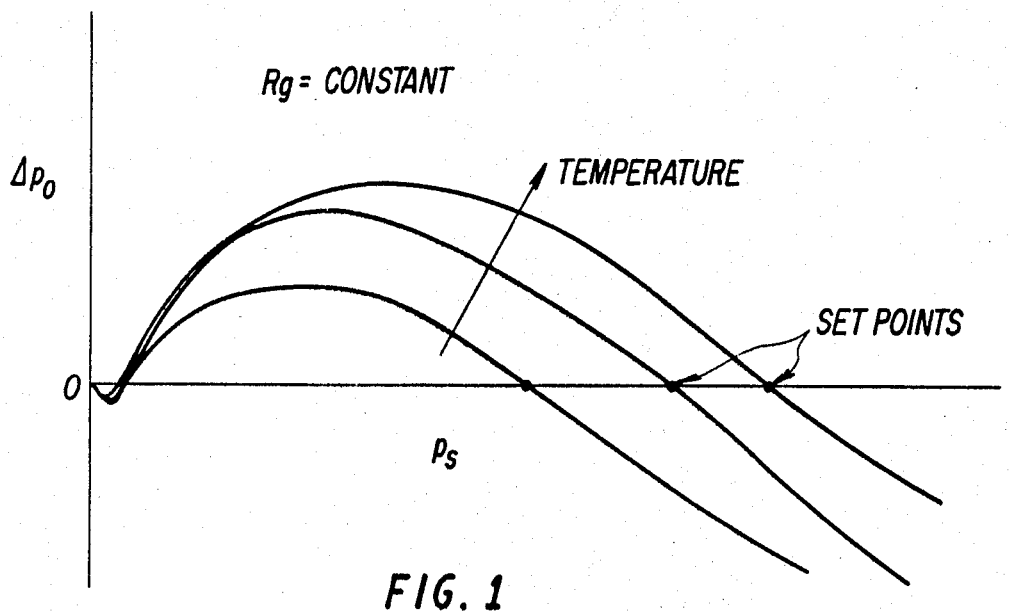
FIG. 1 shows plots of $P_s$ versus $\Delta P_o$ for various values of temperature of the conventional design set-point sensor.

Refering now to the drawings, like reference numerals represent identical or corresponding parts throughout the several views.

FIG. 1 shows typical plots of differential output pressure, $\Delta P_0$, versus supply pressure, $P_s$, for various values of temperature, of a conventional design set-point sensor. As the temperature changes the set-point moves, resulting in a very temperature sensitive device.

Figure 2:
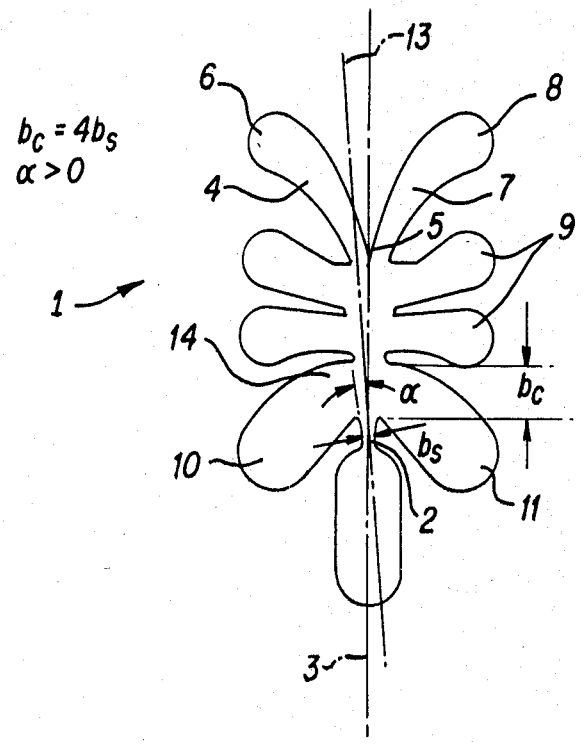
FIG. 2 shows a schematic of a modified laminar proportional amplifier in accordance with the present invention.
Figure 3:
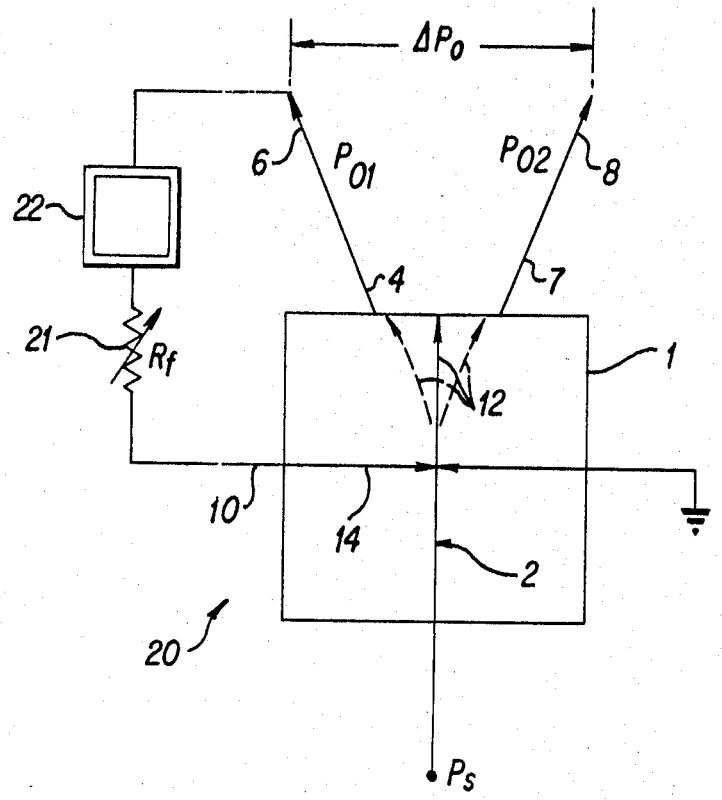
FIG. 3 shows a schematic of a temperature compensated fluidic set-point sensor in accordance with the present invention.
Figure 4:
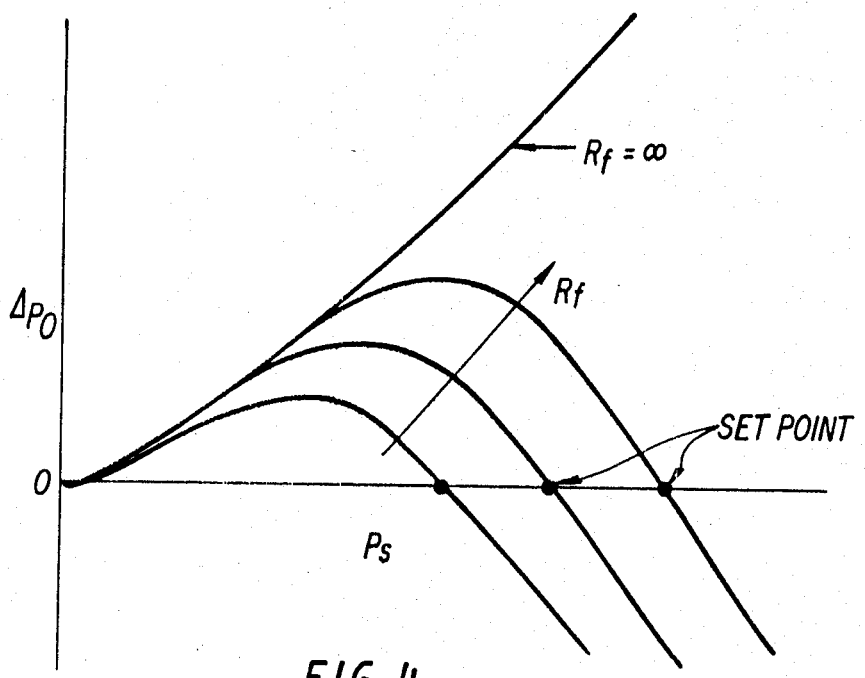
FIG. 4 shows a family of curves of sensor input pressure $P_s$ versus differential output for respective feedback resistances.

FIG. 2 shows an example of a modified LPA 1 in which a supply nozzle 2, with width $b_s$, has been offset at an angle, $\alpha$, about 1 to 5 degrees, from centerline 3 towards a first output receiver 4. Splitter 5 separates the first output receiver 4, with a first outlet 6, from a second output receiver 7, with a second outlet 8. The LPA also includes vents 9, a first inlet 10 and a second inlet 11. The supply nozzle 2, directs a jet of fluid along a centerline 13 towards the first output receiver 4. Control nozzle 14, with width $b_c$, controls the deflection of the jet of fluid. FIG. 3 shows a schematic representation of a fluidic set-point sensor 20 with an adjustable feedback fluidic resistor ($R_f$) 21 in series with a temperature compensated flow controller 22, connecting a first outlet 6 with a first control inlet 10, on the modified LPA 1. For a given supply pressure, $P_s$, and when $R_f$ equals infinity, the offset supply nozzle 2 causes a pressurized supply fluid, at pressure $P_s$, to direct a jet fluid 12 along a supply nozzle centerline 13, as shown in FIG. 2, at a velocity determined by the absolute pressure of the pressurized supply fluid, towards the first output receiver 4. Thus we have an output pressure $P_{01}$ at first outlet 6 and $P_{02}$ at a second outlet 8 in which $P_{01}$ is greater than $P_{02}$ or $\Delta P_0 = P_{01} - P_{02} > 0$. As a result, $\Delta P_0$ increases monotomically with $P_s$ as shown in FIG. 4. By opening up the adjustable feedback resistor 21, in FIG. 3, to allow some output flow from the first outlet 6 to enter the first control inlet 10 and discharge from control nozzle 14, the jet of fluid 13 will gradually deflect towards the second output receiver 7, and $\Delta P_0$ will become zero at a certain value of $P_s$. At this zero crossing point for $\Delta P_0$, the resulting $P_s$ is the set-point pressure. As $P_s$ continues to increase $\Delta P_0$ becomes negative as seen in FIG. 4. Decreasing $R_f$ will move the set-point toward the origin and thus decrease the set-point pressure. The slope $\Delta P_0/\Delta P_s$ around the set-point is a function of the pressure gain, $G_p$ of the LPA.

As described earlier, and shown in FIG. 1, the conventional set-point pressure sensor is very temperature sensitive. The value of the ground resistors in these devices are on the order of $R_g \approx 100\ R_s$ and therefore have a very small flow passage in relation to the supply nozzle flow. The adjustable feedback resistor 21 in the present invention, shown in FIG. 3, has a flow resistance comparable to that of the supply nozzle resistance. The major advantage of this feature over the conventional design is that the set-point pressure sensor may be temperature compensated using a temperature compensated flow controller. A temperature compensated flow controller cannot be used in the conventional design due to the difficulty in designing a controller to compensate for such small dimensional ground resistors. A temperature controller may easily be used, however, in a set-point pressure sensor in which the feedback resistor is on the order of the same size as the nozzle resistance. By placing a temperature controller 22 in the feedback path, in series with the feedback resistor 21, it can adjust the series resistance of the feedback path as a function of temperature to give the desired response.

In order to minimize the effect of temperature of Reynolds number change, we have to increase the supply pressure or flow as the temperature increases. This is due to the fact that the viscosity of the gas increases with increasing temperature. In other words, it is necessary to maintain the ratio of the flow rate to the viscosity at a constant level by increasing the flow rate or pressure with increasing temperature.

An example of a temperature compensated flow controller is disclosed in application Ser. No. 411,074 filed Aug. 24, 1982 by George Mon which is a continuation of Ser. No. 156,568 filed June 4, 1980 and is also disclosed in an article by Mon titled "Temperature Compensation of Laminar Fluidic Components in Systems".

Figure 5:
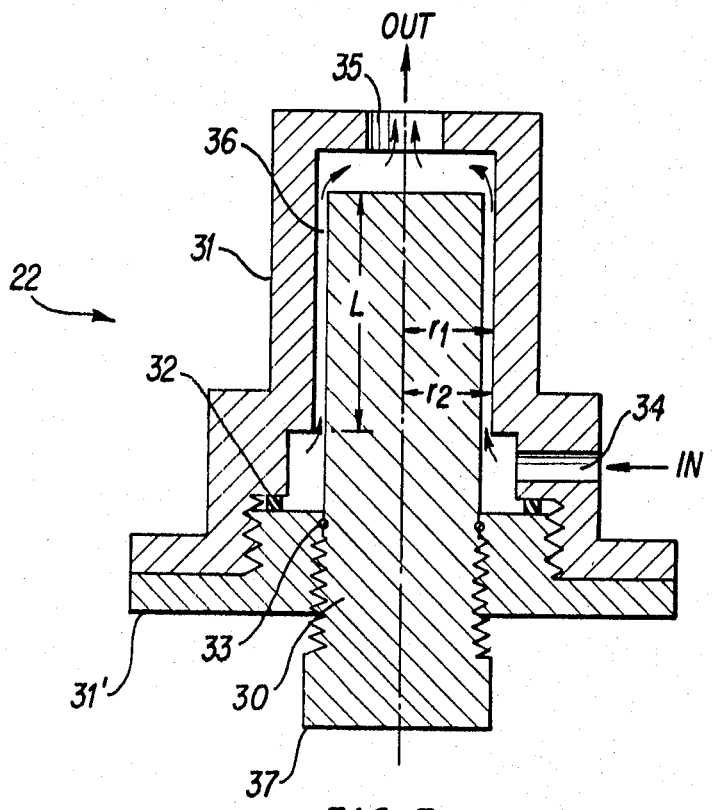
FIG. 5 shows a prior art temperature compensated fluid flow controller.

FIG. 5 shows a sectional view through a generally cylindrical linear resistor temperature compensated flow controller 22. The flow controller of FIG. 5 comprises generally a first inner member 30 and a second outer member 31. The outer member 31 is sealed by means of an end cap 31' and O-ring seal 32. Inner member 30 is threadly engaged with the end cap 31' the interface of these two members being sealed by means of O-ring 33. End portion 37 of member 30 is adapted to be engaged by a rench or other similar tool in order that the position of element 30 with respect to outer member 31 may be adjusted.

Supply flow to the flow controller enters at inlet 34 and exits from the controller at outlet 35. Flow region 36 comprises an annulus defined by the outer surface of inner member 30 and the inner surface of outer member 31. The length of the annulus, as indicated in FIG. 5, is adjustable by virtue of the adjustability of the position of inner member 30.

The flow through an annulus can be written as:

$$\alpha = \frac{(r_1 + r_2)(r_2 - r_1)^3 P}{12\ \mu L}$$

Wherein

L = length of the annulus

P = the pressure drop across the annulus

Q = flow rate $r_1$, $r_2$ = radii of the inner and outer members, respectively and $\mu$ = viscosity of the fluid It is evident that by appropriate selection of the materials of the inner and outer cylindrical members, one can provide for proper modification of the flow or pressure as the fluid temperature changes. In general, the radius r, of either of the cylindrical members can be expressed as:

$$r = r_0[1 + K(T - T_0)]$$

where $r_0$ and $T_0$ are the reference radius and temperature respectively and K is the thermal coefficient of expansion. The difference between the thermal coefficients of expansion of the inner and outer cylindrical members will determine the amounts by which the annulus 36 will expand or contract with changes in temperature.

The purpose of the temperature compensated flow controller is to regulate the flow in the feedback path of the set-point sensor. If $R_f$ represents the resistance of the feedback resistor and $R_c$ represents the resistance of the flow controller the sum total of these resistances may be made to remain constant, increase or decrease, as required to give the desired function in terms of the temperature change. For a temperature insensitive device $R_c$ has to decrease as temperature increases and increase as temperature decreases because the viscosity of gases increases with temperature.

It is to be noted that the flow conditioner in FIG. 5 comprises an outer member 31 which has a thermal coefficient of expansion K2 which is greater in value than K1, the thermal coefficient of expansion of the inner member 30. When K2 is greater than K1 the dimension of the annulus or orifice will increase with increasing temperature. Conversely, when K1 is greater than K2 the dimension of the annulus or orifice will decrease with increasing temperature.

Figure 6:
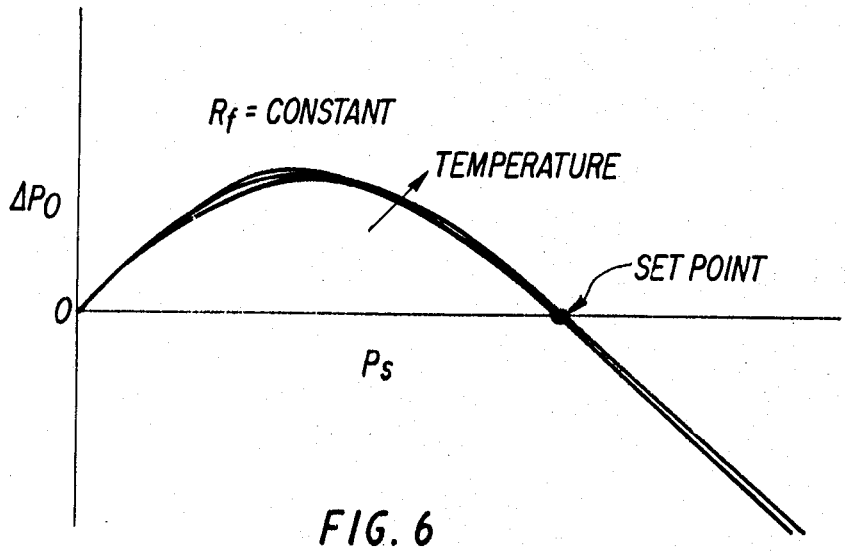
FIG. 6 shows the effect of temperature on the performance characteristics of the temperature fluid setpoint sensor.

A linear resistor flow controller having $K_2$ greater than $K_1$ has been tested in the feedback path of a fluidic set-point sensor as shown in FIG. 6. FIG. 6 shows a typical response of a set-point sensor, with $R_f$ constant, and the effect temperature has on its performance. As can be clearly seen from this response, by using a flow controller in the feedback path of the set-point sensor, the effect of temperature on the system can be eliminated. The set-point no longer moves as a function of temperature. Obviously, numerous modifications and variations of the present invention are possible in light of the above teachings. It is therefore to be understood that within the scope of the appended claims the invention may be practiced otherwise than as specifically described herein.

What is claimed is:

1. A fluidic set-point pressure sensor for converting the absolute pressure of a pressurized fluid to a differential pressure indicating the pressure of the pressurized fluid relative to a predetermined set-point pressure, comprising:

input means, connected to receive said pressurized fluid for directing a jet of fluid along a first centerline at a velocity determined by said absolute pressure;

output means, disposed downstream from said input means, including first and second outlets separated by a splitter which is disposed asymmetrical to said first centerline such that at least a greater portion of said jet directed along said first centerline is received at the first outlet;

control means for deflecting the jet towards the second outlet in accordance with the jet velocity such that as the jet velocity increases from zero, the deflection of the jet increases to a maximum value and then decreases, so that the differential pressure generated by the jet between the first and second outlets increases to a maximum positive value and then decreases to a negative value, the differential pressure being equal to zero when the absolute pressure of the pressurized fluid is equal to the predetermined set-point pressure, the differential pressure becoming positive whenever said absolute pressure fall below said set-point pressure and becoming negative whenever said absolute pressure rises above said set-point pressure, said control means including first and second control fluid inlets respectively disposed on opposite sides of the jet, said first fluid inlet being disposed on the same side of the centerline of said first outlet and a resistive fluid communications means having one end connected to said first outlet and a second end connected to said first inlet forming a feedback path of the portion of said jet flowing into said first outlet.

2. A sensor, as described in claim 1 wherein said resistive fluid communications means comprises an adjustible fluidic resistor.

3. A sensor, as described in claim 1, further comprising a temperature compensated fluid flow controller connected in series with said resistive communications means between said first outlet and said first inlet.

4. A temperature compensated set-point pressure sensor for converting the absolute pressure of a pressurized fluid to a differential pressure indicating the pressure of the pressurized fluid relative to a predetermined set-point pressure, comprising:

input means, connected to receive said pressurized fluid for directing a jet of fluid along a first centerline at a velocity determined by said absolute pressure;

output means, disposed downstream from said input means, including first and second outlets separated by a splitter which is disposed asymmetrical to said first centerline such that at least a greater portion of said jet directed along said first centerline is received at the first outlet; and control means for deflecting the jet towards the second outlet in accordance with the jet velocity such that as the jet velocity increases from zero, the deflection of the jet increases to a maximum value and then decreases, so that the differential pressure generated by the jet between the first and second outlets increases to a maximum value and then decreases, so that the differential pressure generated by the jet between the first and second outlets increases to a maximum positive value and then decreases to a negative value, the differential pressure being equal to zero when the absolute pressure of the pressurized fluid is equal to the predetermined set-point pressure, the differential pressure becoming positive whenever said absolute pressure falls below said set-point pressure and becoming negative whenever said absolute pressure rises above said set-point pressure, said control means including first and second control fluid inlets respectively disposed on opposite sides of the jet, said first fluid inlet being disposed on the same side of the centerline of said first outlet and an adjustable fluidic resistor connected in series with a temperature compensated fluid controller connected between said first outlet and said first inlet, forming a feedback path for the position of said jet flowing into said first outlet.

* * * * *